US012325835B2

(12) United States Patent
Lemke et al.

(10) Patent No.: US 12,325,835 B2
(45) Date of Patent: Jun. 10, 2025

(54) STORAGE-STABLE SPENT POTLINING MATERIAL, METHOD FOR THE PRODUCTION THEREOF, AND USE OF THE SAME AS FUEL

(71) Applicants: Ralf Lemke, Nettetal (DE); Olaf Güßgen, Cologne (DE); Kathrin Eckhard, Cologne (DE); Joachim Höfler, Roetgen (DE); Andreas Beermann, Oberhausen (DE); Thorsten Kensy, Hückelhoven (DE)

(72) Inventors: Ralf Lemke, Nettetal (DE); Olaf Güßgen, Cologne (DE); Kathrin Eckhard, Cologne (DE); Joachim Höfler, Roetgen (DE); Andreas Beermann, Oberhausen (DE); Thorsten Kensy, Hückelhoven (DE)

(73) Assignee: Speira GmbH, Grevenbroich (DE)

( * ) Notice: Subject to any disclaimer, the term of this patent is extended or adjusted under 35 U.S.C. 154(b) by 0 days.

(21) Appl. No.: 18/667,403

(22) Filed: May 17, 2024

(65) Prior Publication Data

US 2024/0301313 A1 Sep. 12, 2024

Related U.S. Application Data

(63) Continuation of application No. PCT/EP2022/083258, filed on Nov. 25, 2022.

(30) Foreign Application Priority Data

Nov. 25, 2021 (EP) ..... 21210576

(51) Int. Cl.
*C10L 5/48* (2006.01)
*C25C 3/06* (2006.01)

(52) U.S. Cl.
CPC ..... *C10L 5/48* (2013.01); *C10L 2200/0453* (2013.01); *C25C 3/06* (2013.01)

(58) Field of Classification Search
CPC ..... C10L 2200/0453; C10L 2200/0484; C10L 2230/14; C10L 2290/06; C10L 2290/24;
(Continued)

(56) References Cited

U.S. PATENT DOCUMENTS 4,784,733 A 11/1988 Cutshall et al.
4,927,459 A 5/1990 Gardner et al.
(Continued)

FOREIGN PATENT DOCUMENTS

CN 102011147 A 4/2011
CN 105908217 A 8/2016
(Continued)

OTHER PUBLICATIONS

CN115427141-A English Translation (Year: 2022).*

*Primary Examiner* — Ellen M McAvoy
*Assistant Examiner* — Chantel Graham
(74) *Attorney, Agent, or Firm* — Reinhart Boerner Van Deuren P.C.

(57) ABSTRACT

Spent potlining material contains spent potliner from aluminium electrolysis cells, and at least one hydrophobic binder. The hydrophobic binder being selected from wax, a waxlike compound or mixtures thereof. A method for producing a spent potlining material includes the steps of (a)
(Continued)

providing spent potliner from aluminium electrolysis cells, (b) comminuting the spent potliner in at least one comminuting apparatus, (c) fractionating the spent potliner through a separating apparatus, (d) mixing the spent potliner with at least one hydrophobic binder, selected from wax, a waxlike compound or mixtures thereof, in a mixing apparatus, (e) portioning the mixture obtained in step (d), (f) withdrawing the spent potlining material The steps (b) to (d) are carried out in an inert gas atmosphere. Also, spent potlining material is used as fuel in power stations and also in connection with the production of mineral wool, cement and steel.

14 Claims, 1 Drawing Sheet

(58) Field of Classification Search
CPC ..... C10L 2290/28; C10L 2290/546; C10L 5/146; C10L 5/361; C10L 5/363; C10L 5/48; C10L 9/10; C25C 3/06
See application file for complete search history.

(56) References Cited

U.S. PATENT DOCUMENTS

| | | | |
|---|---|---|---|
| 5,683,663 | A | 11/1997 | Keller et al. |
| 2004/0146440 | A1 | 7/2004 | Ignasiak |
| 2005/0053410 | A1 | 3/2005 | Mazumder |
| 2011/0081284 | A1 | 4/2011 | Weaver et al. |
| 2014/0041560 | A1 | 2/2014 | Caron et al. |

FOREIGN PATENT DOCUMENTS

| | | | | | |
|---|---|---|---|---|---|
| CN | 115427141 | A | * | 12/2022 | ..... A01K 1/0152 |
| DE | 10146614 | A1 | | 1/2003 | |
| ES | 2306618 | A1 | | 11/2008 | |
| GB | 2121433 | A | | 12/1983 | |
| JP | S59161490 | A | | 9/1984 | |
| JP | 2007136274 | A | | 6/2007 | |
| KR | 101460441 | B1 | | 11/2014 | |
| TW | I633181 | B | | 8/2018 | |
| WO | WO-8806572 | A | * | 9/1988 | ..... C03B 5/12 |
| WO | WO 8806572 | A1 | | 9/1988 | |

* cited by examiner

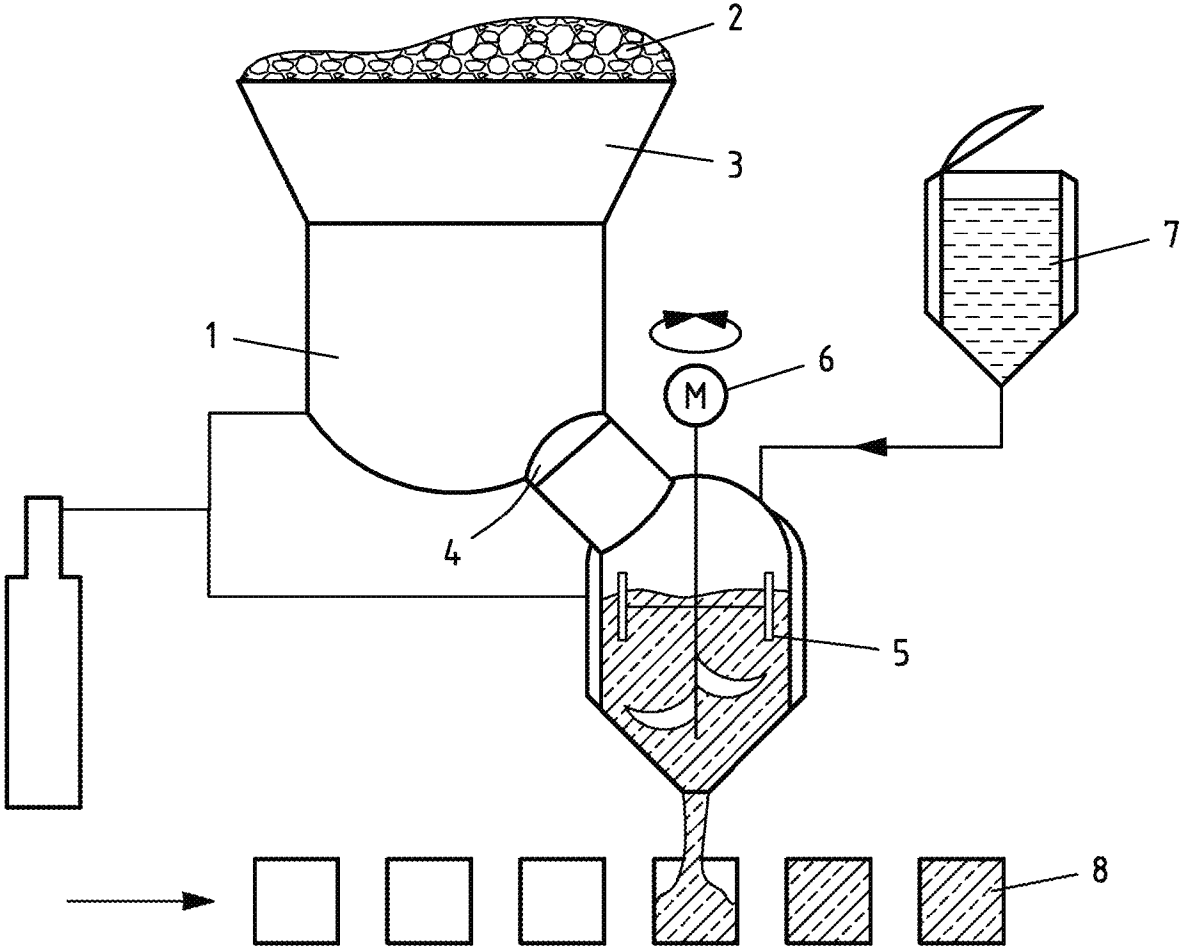
7
8
5
6
M
2
3
4
1

STORAGE-STABLE SPENT POTLINING MATERIAL, METHOD FOR THE PRODUCTION THEREOF, AND USE OF THE SAME AS FUEL

CROSS-REFERENCE TO RELATED PATENT APPLICATIONS

This patent application is a continuation of International Application No. PCT/EP2022/083258, filed on Nov. 25, 2022, which claims the benefit of priority to European Patent Application No. 21210576.1, filed Nov. 25, 2021, the entire teachings and disclosures of both applications are incorporated herein by reference thereto.

FIELD OF THE INVENTION

The invention relates to a spent potlining material, a method for the production thereof, and the use thereof as a fuel, preferably in power stations and in the production of mineral wool, cement, and steel.

BACKGROUND OF THE INVENTION

Aluminum is usually produced by fused-salt electrolysis in aluminum electrolysis cells using the Hall-Héroult process. During the electrolysis of the molten mixture of aluminum oxide and cryolite, the aluminum formed is deposited on the cathode, and oxygen reacts with the graphite of the anode to form carbon dioxide and carbon monoxide. Over time, the graphite anodes are used up and need to be replaced.

The cathode lining, which also mainly consists of graphite, is inert to aluminum. However, sodium from the molten bath is absorbed by the cathode lining and forms intercalation compounds that change the wetting behavior of the cathode lining with respect to the electrolyte. The molten cryolite and aluminum oxide salts can then penetrate more easily through pores and cracks in the cathode lining and completely impregnate it over time, which worsens the productivity of the electrolysis cell and its energy consumption. Furthermore, the content of iron and silicon impurities in the aluminum is increased.

For this reason, the average operating time of the cathode lining in industrial aluminum electrolysis cells is usually between 4 and 7 years. The actual service life can also be significantly shorter if premature failure of the cathode lining occurs, usually due to cracks in the cathode lining.

To replace the cathode lining of the aluminum electrolysis cell, the cathode lining is excavated mechanically, for example by using pneumatic hammers, and removed. The resulting spent potliner, also called "spent pot lining (SPL)," is industrially divided into a "first cut," which contains material of the cathode lining, and a "second cut," which contains a mixture of material of the cathode lining and the refractory lining.

Depending upon the further disposal of the spent potliner, the first cut, which consists of the graphite of the cathode lining, is separated from the second cut, which is a mixture of the graphite of the cathode lining and the refractory lining. Typically, the spent potliner consists of about 55% of the first cut and 45% of the second cut.

The spent potliner of the first cut mainly consists of graphite with a low content of volatile components and sulfur. However, toxic compounds such as cyanides, e.g., in the form of sodium cyanide and fluoride compounds, accumulate on or in the cathode lining during aluminum electrolysis. These toxic compounds are highly reactive with water and/or air, especially oxygen, which can lead, among other things, to heat generation, toxic gas formation, and ignition. Spent potliner is therefore classified in most countries as hazardous waste and dangerous good 13 for example, in the sense of the European Agreement on the International Carriage of Dangerous Goods by Road (ADDR). In particular, spent potliner is designated in the transport documents as UN3170 WASTE, BY-PRODUCTS OF ALUMINUM PRODUCTION, 4.3, III, (E) and is classified as a dangerous good of Class 4.3: "Substances which, in contact with water, emit flammable gases."

The reactivity with water and/or atmospheric oxygen limits the usability of the spent potliner or requires more complex storage conditions and disposal routes, and increases the associated costs.

Currently, most of the spent potliner from aluminum production worldwide is deposited in landfills. On the one hand, in countries with less stringent regulations, deposits in landfills are carried out without any further treatment of the spent potliner. In other countries, complex thermal or wet-chemical treatment has been recognized as necessary before deposits in landfills and as the prior art. At the same time, spent potliner has a very interesting thermal heating value due to its high carbon content, so that the use of spent potliner as a fuel is desirable as a possible disposal method.

However, the use of the spent potliner, which is classified as a hazardous material, as a fuel is limited by the complex transport, storage, and processability. In addition, the usability of the spent potliner as a fuel and its disposal costs depend heavily upon the size of the fragments of the spent potliner.

While larger fractions of the spent potliner can be disposed of by transferring them to a recycler for use as fuel at comparatively low cost, it is difficult to find a use for smaller gritty fractions and dusts of the spent potliner, because they often cannot be used as fuel in the recycling plants due to their large surface area and the associated higher reactivity. The higher reactivity of the smaller fractions of the spent potliner makes them more dangerous and therefore more difficult to transport and handle. The disposal of these small fractions of spent potliner is therefore correspondingly complex and expensive.

WO 2014/026138 A1 describes a spent potliner having a carbon content of at least 65 wt. % and its use as a fuel. The high carbon content is produced by using only the first cut of the spent potliner and optionally adding a carbon-enriching compound to it, wherein the carbon-enriching compound is selected from compatible metallurgical residues, such as by-products of the graphite anodes or graphite cathode production. Such by-products are not specified in WO 2014/026138 A1, but could, for example, be dusts, fragments, or offcuts from production scrap. Although the carbon-enriched spent potliner produced in this process has a higher heating value, it is still a hazardous material due to the cyanides and fluorides contained in the spent potliner, which are highly reactive with water and/or atmospheric oxygen.

WO 88/06572 A1 describes methods for the production of mineral wool in which, among other things, briquettes that comprise a mixture of spent potliner and hard coal coke as well as coke oven pitch are used as part of the fuel feed to the mineral wool cupola furnace. This is intended to reduce unwanted silicon deposits in the oven that occur during the production of the mineral wool. The briquette should preferably contain approx. 40% hard coal coke, 0.45% spent potliner, and 15% coke oven pitch. The disadvantage of these briquettes is that they contain only extremely small amounts of spent potliner, and therefore only a small proportion of the spent potliner can be recycled and disposed of as fuel. Furthermore, the coke oven pitch used as a binder is technically difficult to handle due to its high stickiness, the processing window at high temperatures, and the partly carcinogenic ingredients, such as polycyclic aromatic hydrocarbons.

SUMMARY OF THE INVENTION

Against this background, the object of the invention was to provide a spent potlining material which ensures safe storage and safe transport even of smaller-grained fractions and dusts of the spent potliner, and does not have the disadvantages mentioned in the prior art. A further object of the invention was to provide a simple method for producing such a spent potlining material.

This object is achieved by a spent potlining material containing spent potliner, in particular from aluminum electrolysis cells, and at least one hydrophobic binder, wherein the hydrophobic binder is selected from wax, a wax-like compound, or mixtures thereof.

Another subject matter of the invention is a method for producing a spent potlining material and the use of the spent potlining material according to the invention as a fuel.

Surprisingly, it was found that by adding a hydrophobic binder selected from wax, a wax-like compound, or mixtures thereof to spent potliner, a spent potlining material is obtained which has no appreciable reactivity to water and/or atmospheric oxygen, so that its storage and transportation stability is ensured. By adding the hydrophobic binders according to the invention, the spent potliner is inerted to such a complete extent that it is no longer considered waste to be transported as hazardous material. In particular, the spent potlining material according to the invention no longer develops flammable gases upon contact with water and therefore no longer has to be transported as dangerous goods of subclass 4.3 and provided with corresponding transport documents. Thus, the spent potlining material according to the invention can be stored and transported without difficulty, which makes its disposal as fuel, preferably in power plants and in the production of mineral wool, cement, and steel, more cost-effective and thus economically more attractive than landfilling. Recycling as a fuel is also preferable to landfilling from an ecological point of view.

A further advantage of the solution according to the invention is that the presence of the hydrophobic binder, selected from wax, a wax-like compound, or mixtures thereof, in the spent potlining material according to the invention further increases the heating value of the spent potliner according to the proportion of hydrophobic binder added, so that fluctuations in heating value between different batches of the spent potliner are no longer significant when it is used as a fuel. Surprisingly, it was found that, with the spent potlining material according to the invention, it is possible to adjust the combustion behavior within large degrees of freedom and therefore to optimize it when used as fuel for the respective recycling process, so that it can be precisely adapted to the requirements of the corresponding further processing method.

An additional advantage of the invention is that the small gritty fractions and dusts of the spent potliner, which are highly reactive with water and/or atmospheric oxygen due to their high surface area, can also be agglomerated and largely inerted with the hydrophobic binder, which is selected from wax, a wax-like compound, or mixtures thereof, so that these components of the spent potliner, which were previously difficult and expensive to dispose of due to their reactivity and size, can also be used cost-effectively and safely as fuel. For example, the size of the spent potliner that can be used for mineral wool production is usually limited to fractions larger than 50 mm in order to ensure a certain gas permeability of the furnace charge. With the method according to the invention, it is also possible to agglomerate the small fractions below 50 mm of the spent potliner by means of the hydrophobic binder, which is selected from wax, a wax-like compound, or mixtures thereof, to form a spent potlining material adapted in size to the specifications of the respective further processing method.

In the context of the present invention, a distinction is made between spent potliner and spent potlining material. Spent potlining material in the sense of the invention means that the spent potliner with the hydrophobic binder is present in agglomerated form. Agglomerated means that the individual particles of the spent potliner are bound together into larger structures by means of the hydrophobic binder.

The spent potlining material according to the invention contains spent potliner, in particular from aluminum electrolysis cells.

In contrast to the spent potlining material, spent potliner is understood according to the invention to mean the raw material obtained during the mechanical excavation and removal of the cathode lining, in particular the cathode lining of an aluminum electrolysis cell. Spent potliner in the sense of the invention is also referred to as spent pot lining (SPL). The spent potliner is free of a hydrophobic binder.

In practice, a distinction is made between the first cut and the second cut of a spent potliner from aluminum electrolysis cells. While the first cut consists of only the material of the cathode lining of the electrolysis cell, and, thus, substantially of graphite, the second cut also contains parts of the refractory lining of the electrolysis cell.

The spent potliner in the spent potlining material according to the invention may consist of the first cut or the second cut, or a mixture of the first and second cuts. This makes it possible to adjust the spent potlining material to the specifications of the respective further processing method. For example, when using the spent potliner as fuel in the production of cement, the first and second cuts are usually used, whereas, in the production of mineral wool, only the first cut is usually used.

The first cut of the spent potliner typically comprises 40 to 75 wt. %, 10 to 20 wt. % fluoride, 8 to 17 wt. % sodium, up to 10 wt. % aluminum oxide, up to 5 wt. % aluminum (metal), 0.01-0.5 wt. % cyanide, up to 6 wt. % silica, 1 to 6 wt. % calcium oxide, 0.1 to 0.3 wt. % sulfur, and up to 300 ppm polycyclic aromatic hydrocarbons.

The second cut of the spent potliner typically comprises 0 to 20 wt. % carbon, 4 to 10 wt. % fluoride, 6 to 14 wt. % sodium, 10 to 50 wt. % aluminum oxide, 10 to 50 wt. % silicon dioxide, 1 to 8 wt. % calcium, and 0.1 to 0.3 wt. % sulfur.

The composition of the first cut of the spent potliner varies as a function of the operating time of the cathode lining until its excavation. The composition of the second cut, which consists of the refractory lining and a small proportion of the cathode lining, is less dependent upon the operating time of the cathode lining. However, their composition can also vary due to different proportions of refractory lining and cathode lining during the excavation.

A mixture of the first and second cut of the spent potliner typically comprises 25 to 35 wt. % carbon, 12 to 18 wt. % fluoride, 12 to 18 wt. % sodium, 12 to 18 wt. % aluminum, up to 0.28 wt. % cyanide, up to 3.5 wt. % silica, up to 3.5 wt. % calcium oxide, 0.1 to 0.3 wt. % sulfur, and up to 165 ppm polycyclic aromatic hydrocarbons.

Preferably, a mixture of the first and the second cuts of the spent potliner comprises 50 to 60 wt. % of the first cut and 40 to 50 wt. % of the second cut.

The spent potliner contained in the spent potlining material according to the invention can be present in any form and size that is in principle suitable for agglomeration with a hydrophobic binder. However, it has proven to be advantageous for the production of pellets, castings, briquettes, or extrudates if the spent potliner is as homogeneous as possible in terms of grain size. By using the most homogeneous grain sizes possible for the spent potliner, the pellets, castings, briquettes, or extrudates produced with it are more stable, and a uniform quality can be ensured in terms of properties, such as calorific value, from one individual pellet, casting, briquette, or extrudate to the next individual pellet, casting, briquette, or extrudate.

Preferably, the spent potliner therefore has a grain size of less than 50 mm, in particular less than 30 mm, and especially preferably less than 0.2 mm. The spent potliner can be ground to the target fineness using a suitable grinder. The individual finenesses can be separated into suitable fractions by screening. Depending upon the desired end product (pellet, casting, briquette, or extrudate), different particle sizes can be advantageous. For the production of pellets and extrudates, for example, the smallest and most homogeneous particle sizes possible are advantageous, while coarser particle sizes and less homogeneous particle size distributions can also be used for the production of castings and briquettes.

The spent potlining material according to the invention contains at least one hydrophobic binder selected from wax, a wax-like compound, or mixtures thereof.

A hydrophobic binder in the sense of the invention is understood to be a binder which is not miscible with water. While hydrophobic binders are almost insoluble in water, they dissolve in organic, non-polar media.

Waxes are usually defined as substances or mixtures of substances that are kneadable at 20° C., solid to brittle-hard, have a coarse to fine crystalline structure, are translucent to opaque in color but not transparent, and melt above 40° C. without decomposition and are already thin or have a low viscosity slightly above the melting point, have a strongly temperature-dependent consistency and solubility, and can be polished under light pressure.

A wax-like compound is a compound that has a similar physical behavior to a wax.

According to the invention, all natural, semi-synthetic, and synthetic waxes known to a person skilled in the art can be used as hydrophobic binders.

Examples of natural waxes are wool wax, china wax, beeswax, brush gland fat, tallow, sugar cane wax, carnauba wax, candelilla wax, cork wax, guruma wax, ouicuri wax, cuban palm wax, esparto wax, cotton wax, rice bran wax, flax wax, peat wax, rose wax, jasmine wax, peetha wax, myrtle wax, ficus variegata wax, petroleum wax, mineral waxes, stuff wax, vein wax, montan wax, petroleum wax, and paraffin wax.

Examples of semi-synthetic waxes are ester waxes from long-chain wax acids with monohydric fatty or wax alcohols, amides of fatty and wax acids, amide waxes based upon fatty acids, such as distearyl ethylene diamide, ethylene distearmide, stearic acid amide, behenic acid amide, erucic acid amide, oleic acid amide, soy wax, rhizinus wax, rapeseed wax, phthalamide waxes, and acylated amides of fatty and wax acids.

Examples of synthetic waxes are hydrocarbon waxes, polyolefin waxes such as polyethylene wax, EVA waxes and polypropylene wax, polyester waxes, and Fischer-Tropsch waxes.

The wax is preferably selected from polyolefin waxes, in particular polyethylene waxes, or paraffin waxes.

The use of conventional wax-like compounds known to a person skilled in the art is also possible in principle according to the invention.

Preferably, the wax-like compound is selected from esters of glycerol with fatty acids, preferably from linear carbon chains having 4 to 26, typically 12 to 22, carbon atoms, fatty acids, in particular linear aliphatic monocarboxylic acids having 13 to 21 carbon atoms, and mixtures thereof, preferably from stearin.

The use of at least one hydrophobic binder, selected from wax, a wax-like compound, or mixtures thereof, which has a dripping point between 35° C. and 75° C. according to DIN ISO 2176, has proven to be particularly practical.

Hydrophobic binders with a dripping point in this range have a good balance between sufficient strength at ambient temperature and the most energy-efficient method possible for producing the spent potlining material. Due to the comparatively low dripping point, the amount of energy that must be supplied to liquefy the hydrophobic binder during the production of the spent potlining material is lower than for hydrophobic binders with a dripping point according to DIN ISO 2176 of over 75° C. and more.

The dripping point of the hydrophobic binder can advantageously be selected depending upon the time of year and/or the climate zone in which the spent potlining material is to be stored and transported, in order to ensure that the hydrophobic binder is sufficiently solid at ambient temperature. In a colder season and/or a temperate climate zone, a hydrophobic binder with a dripping point according to DIN ISO 2176 in the range between 35° C. and 45° C. is already sufficient, while, in the warmer season and/or the subtropical and tropical climate zones, a hydrophobic binder with a dripping point according to DIN ISO 2176 in the range between 45° C. and 75° C. can be advantageous.

It is also particularly advantageous if the hydrophobic binder contains as few functional groups as possible, and preferably is free of functional groups. Functional groups are defined here as chemical groups that differ from pure carbon-carbon or carbon-hydrogen single bonds. Such a hydrophobic binder causes a further significant reduction in the reactivity of the spent potlining material according to the invention with water and/or atmospheric oxygen, so that its storage and transport stability is further improved. Furthermore, the higher carbon content in the hydrophobic binder also increases the heating value of the spent potlining material when it is used as fuel.

According to a particularly preferred embodiment of the invention, the spent potlining material has a heating value of between 10,500 and 31,000 KJ/kg, determined according to the RAL-GZ 724 method of the German Federal Quality Association for Secondary Fuels. The addition of the hydrophobic binder significantly increases the heating value of the spent potlining material, which is usually in the range of 7,500 to a maximum of 10,000 KJ/kg.

The spent potlining material according to the invention can be adapted to the requirements of the respective further processing method. Depending upon the further processing method, the spent potlining material can advantageously be in the form of pellets, cocoons, castings, briquettes, or extrudates.

According to a preferred embodiment of the invention, the spent potlining material is in the form of pellets or extrudates and contains 75 to 90 wt. % spent potliner and 10 to 25 wt. % hydrophobic binder, relative to the total weight of the spent potlining material.

Spent potlining material in the form of easily metered pellets or extrudates is advantageous for the use of spent potlining material as a fuel in heating-value-controlled combustion—for example, in the production of cement in a rotary kiln or in the operation of a power plant. Here, the target temperature can be reliably predicted by charging with a homogeneous fuel of known calorific value. The smaller the form of administration of the fuel, the more finely the temperature can be controlled. Achieving a target temperature within certain limits can be important for maintaining the quality of the product produced.

According to an alternative preferred embodiment of the invention, the spent potlining material is in the form of briquettes and contains 60 to 80 wt. % spent potliner and 20 to 40 wt. % hydrophobic binder, relative to the total weight of the spent potlining material.

Spent potlining material in the form of briquettes is advantageous for the use of spent potlining material as fuel in coarse heating value-controlled combustion, e.g., in cupola furnaces used in the production of mineral wool, and in batch furnaces—for example, in electric arc furnaces such as those used in steel production. With briquettes, the necessary gas permeability of the feed can be achieved more easily due to the coarser form of administration compared to pellets; at the same time, despite the coarser form of administration, a reliable setting of the target temperature is possible by charging with homogeneous fuel of known calorific value.

According to a further alternative preferred embodiment of the invention, the spent potlining material is in the form of castings and contains 30 to 80 wt. % spent potliner and 20 to 70 wt. % hydrophobic binder, relative to the total weight of the spent potlining material.

Spent potlining material in the form of castings is advantageous for the use of the spent potlining material as fuel in coarse heating-value-controlled combustion, e.g., in cupola furnaces used in the production of mineral wool, as well as in batch furnaces, e.g., electric arc furnaces. As with the use of briquettes, the casting molds make it possible to feed a lot of fuel into the process in a gas-permeable manner, while at the same time allowing reliable temperature adjustment thanks to the homogeneous fuel having a known calorific value.

The invention further provides a method for producing a spent potlining material, comprising the following steps:

(a) providing spent potlining material, in particular from aluminum electrolysis cells,
(b) comminuting the spent potliner in at least one comminuting apparatus,
(c) fractionating the spent potliner through a separating apparatus,
(d) mixing the spent potliner with at least one hydrophobic binder, selected from wax, a wax-like compound, or mixtures thereof, in a mixing apparatus,
(e) portioning the mixture obtained in step (d),
(f) extracting the spent potlining material,
wherein steps (b) to (d) are carried out in an inert gas atmosphere.

The method according to the invention is characterized by the fact that it ensures a simple, cost-effective, and energy-efficient production of the spent potlining material. What has been said above with regard to individual technical features of the spent potlining material according to the invention applies accordingly to the corresponding technical features of the method according to the invention.

Step (a) of the method according to the invention provides for the provision of spent potlining material, in particular from aluminum electrolysis cells. The provision of the spent potliner in step (a) can take place in any form and size of spent potliner and is limited only by the technical possibilities of transporting the spent potliner. Thus, according to the invention, both coarse pieces and plates of the spent potliner of more than 1 m in length and the finest dusts of the spent potliner as well as mixtures with a wide variety of grain sizes and plate sizes, as usually occur during the mechanical excavation of a cathode lining, can be used in step (a).

In step (b) of the method, the spent potliner is comminuted in at least one comminuting apparatus. The at least one comminuting apparatus can be any comminuting apparatus known to a person skilled in the art. Preferably, the at least one comminuting apparatus in step (b) is a mill or a crusher. Ball mills, impact mills, hammer mills, vertical mills, or shredders can be used here, for example. The at least one comminuting apparatus causes a reduction in the plate and/or particle size of the spent potlining material.

In step (c) of the method according to the invention, the spent potliner is fractionated through a separating apparatus. According to the invention, such separating apparatuses can be used which ensure a homogeneous grain size of the spent potlining material. Preferably, the separating apparatus in step (c) is a sieve. However, other separation apparatuses are also conceivable in principle with which a fine fraction of a certain grain size of the spent potliner can be separated from the spent potliner comminuted in step (b). The fractionating in step (c) can preferably take place at the same time as the comminuting in step (b). However, it is also conceivable that fractionation only take place after comminuting in step (b).

The method according to the invention provides that, in step d), mixing the spent potliner with at least one hydrophobic binder, selected from wax, a wax-like compound, or mixtures thereof, is carried out in a mixing apparatus. Such mixing apparatuses are generally familiar to those skilled in the art. Preferably, the at least one hydrophobic binder is added to the mixing apparatus in liquid form in step (d) or liquefied by heating in the mixing apparatus. Metering in liquid form can be achieved, for example, by feeding the hydrophobic binder to the mixing apparatus from a separate, heated storage container. However, it is also conceivable that the mixing apparatus itself be able to be heated or that the wax be liquefied by the energy input of the mixing unit in the mixing apparatus.

Steps (b) to (d) of the method according to the invention are carried out in an inert gas atmosphere. This is necessary because the spent potlining material, especially the fine fractions produced in step (b), are highly reactive with water and/or atmospheric oxygen, which, as already explained at the beginning, can lead to heat generation, toxic gas generation, and ignition, among other things. Such a reaction should therefore be avoided at all costs from a safety point of view. Noble gases such as helium, neon, argon, krypton, and xenon as well as nitrogen can be used as inert gases. For economic reasons, the use of nitrogen according to the invention is preferred.

In step (e) of the method according to the invention, the mixture obtained in step (d) is portioned. Preferably, the portioning in step (e) is selected from in-mold casting, briquetting, extruding, or pelletizing.

It is also conceivable to fill the mixture obtained in step (d) into previously prepared solid cocoons of the hydrophobic binder. The advantage of this variant is that less homogeneous spent potliner can also be processed. Fractionation in step (c) is therefore not absolutely necessary for this embodiment. The hydrophobic binder cocoon can be a geometric hollow shape, in particular a hollow sphere or a hollow cylinder, wherein a hollow sphere is preferred. The portioning in step (e) for the hollow sphere cocoon embodiment would proceed in such a way that the mixture obtained in step (d) is filled into a solid hollow hemisphere made of the hydrophobic binder, and the other solid hollow hemisphere after heating, and thus softening, the peripheral edge of the hollow hemisphere is then set like a lid on the hollow hemisphere filled with the cathode fraction, so that the cathode fraction is completely enclosed by the solid cocoon of hydrophobic binder.

Depending upon the desired portioning type in step (e) of the method according to the invention, preferably different proportions of spent potliner and binders are mixed in step (d).

According to a preferred embodiment of the invention, the portioning is a pelletizing or extrusion, and, in step (d), 75 to 90 wt. % spent potliner and 10 to 25 wt. % hydrophobic binder, relative to the total weight of the mixture of spent potliner and hydrophobic binder, are mixed.

According to an alternative preferred embodiment of the invention, the portioning is a briquetting, and, in step (d), 60 to 80 wt. % spent potliner and 20 to 40 wt. % hydrophobic binder, relative to the total weight of the mixture of spent potliner and hydrophobic binder, are mixed.

According to a further, alternative preferred embodiment of the invention, the portioning is an in-mold casting and, in step (d), 30 to 80 wt. % spent potliner and 20 to 70 wt. % hydrophobic binder, relative to the total weight of the mixture of spent potliner and hydrophobic binder, are mixed.

The method according to the invention provides that the spent potlining material be extracted in step (f). The spent potlining material extracted in step (f) is preferably present in the aforementioned forms of administration.

The spent potlining material can be coated with a release agent, before removal in step (f), to prevent the spent potlining material from sticking together during storage and transport. Powdery substances are conceivable as release agents. Examples of release agents are calcium carbonate, talc, or silicates.

The method according to the invention can be carried out semi-continuously or continuously.

Finally, the invention relates to the use of the spent potlining material according to the invention as a fuel, preferably in power plants and in the production of mineral wool, cement, and steel.

Depending upon the recycling process in which the spent potlining material is ultimately used as fuel, the combustion behavior of the spent potlining material must be adapted to the different requirements of the respective recycling process. This can be achieved with the spent potlining material according to the invention by varying the proportions of spent potliner to hydrophobic binder, by selecting the hydrophobic binder, and by different forms of administration, such as granules, pellets, briquettes, cocoons, extrudates, and castings.

If an increased strength of the fuel even at high temperatures is required for the use of the spent potlining material as a fuel, the spent potlining material according to the invention can also be used in dimensionally stable fuel composite molded bodies, which are used, for example, in the production of mineral wool.

In addition to the spent potlining material, such fuel composites usually comprise a hydraulically hardening binder such as cement, in particular Portland cement. Due to the advantageous inertness of the spent potlining material according to the invention, such fuel composite molded bodies can be produced by incorporating the cathode material according to the invention, without a reaction of the spent potlining material with the water used in the production of the fuel composite bodies.

It goes without saying that the spent potlining material according to the invention is also suitable as a starting material for the production of other conceivable fuel composite molded bodies, which are adapted in each case to the different requirements of the respective recycling process.

With regard to the technical features of the spent potlining material according to the invention and its design and production, the above applies accordingly with regard to the cathode material according to the invention and with regard to the method for its production.

The invention is described in more detail below using an exemplary embodiment with reference to the attached FIGURE. The example serves only to illustrate the invention and does not limit the scope of protection.

BRIEF DESCRIPTION OF THE DRAWINGS

FIG. 1 is a Schematic representation of an embodiment of the method according to the invention for the production of spent potlining material.

DETAILED DESCRIPTION OF THE INVENTION

FIG. 1 schematically shows an embodiment of the method according to the invention for the production of spent potlining material. First, a nitrogen-inert mill is fed with the spent potliner 2 having a particle size of less than 50 mm via a vibrating hopper 3. If fragments are too coarse or the range in the size distribution is too large to be fed to a mill, a nitrogen-inert crusher can also be installed upstream. The served spent potliner 2 also acts as a dust separator. The final particle size with which the fine fraction of the spent potliner is released from the mill into the heated mixer 5 is determined using a sieve 4 close to the bottom. In the mixer 5, liquefied wax is added via a dosing unit 6 up to a concentration of 20 to 40 wt. % wax, relative to the total weight of the spent potlining material. The wax has been previously liquefied in a heated wax storage container 7. When the correct mixing ratio of wax and spent potliner is reached in mixer 5, the mill 1, the crusher (if connected upstream), and the addition of wax are stopped via dosing unit 6. The mixing direction in mixer 5 is changed, and the spent potlining material/wax mixture is poured into slightly conical molds 8. After cooling to room temperature, the finished spent potlining material can be removed from the casting molds 8 and is thus present as a casting.

EXAMPLES 1,300 kg of spent potliner were delivered to a vertical mill. The spent potliner was pre-sorted, free of impurities such as corundum or aluminum, and contained no pieces larger than 5 cm.

The grinding process took place in a nitrogen atmosphere and was carried out with a target fineness of 10%>90 μm. This means that 90% of the spent potliner was smaller than 90 μm at the end of grinding, with the remaining 10% between 150 and 200 μm.

Pellet Production—Variant A—Partial Pelletizing 1,800 g of the ground spent potliner were placed on a pelletizing plate, which was preheated to 70° C. By adding 10 to 15 wt. % wax, pellets were obtained which had formed a firm, round shell on the outside, but contained almost dry ground material on the inside.

Pellet Production—Variant B—Full Pelletizing

In another example, 1,800 g of the ground spent potliner were placed on a pelletizing plate preheated to 80° C., and 17 to 21 wt. % wax was added. Pellets were obtained that contained a mixture of wax and ground material over the entire diameter. The angle of incidence of the pelletizing plate during the production of the pellets was 30° relative to plumb, and the rotational speed was 30 rpm.

Pelletizing was carried out in a semi-continuous method in which the ground spent potliner was fed in such a way that the pellet extraction (falling over the edge) was proportional to the mass. The preheated, liquid wax was also dosed (or sprayed on) in the appropriate ratio. The angle of incidence of the pelletizing plate during the production of the pellets was 30° relative to plumb, and the rotational speed was 30 rpm.

Heating value and calorific value analyses according to RAL-GZ 724 were subsequently carried out for both partial pelletizing and full pelletizing. The results are summarized in Table 1.

TABLE 1

| | Calorific value original substance | Calorific value dry substance | Heating value original substance | Heating value dry substance |
|---|---|---|---|---|
| partially pelletized | 22,982 [kJ/kg] | 23,121 [kJ/kg] | 21,359 [kJ/kg] | 21,502 [kJ/kg] |
| pelletized | 28,606 [kJ/kg] | 28,692 [kJ/kg] | 26,596 [kJ/kg] | 26,684 [kJ/kg] |

The "original substance" specified in Table 1 refers to the pellets as they were extracted from the pelletizing machine. The term "dry substance" refers to pellets that have undergone drying according to DIN EN 14346 after extraction from the pelletizing machine.

By varying the rotational speed from 20 to 40 rpm and the angle of incidence from 15° to 30° relative to plumb, pellets having different average diameters d=8 to 17 mm can in principle be obtained.

Production of Castings

In another example, castings were produced. For this purpose, a screen fraction <3 mm was separated from the fine fraction of the spent potliner and used.

In a batch process, approx. 3 kg of paraffin with a melting point between 70 and 80° C. were liquefied and heated to approx. 100° C. The kinematic viscosity at 100° C. is between 3 and 10 $mm^2$/sec.

With constant stirring, 10 kg of the screen fraction <3 mm separated from the fine fraction of the spent potliner were slowly added in small portions. After everything was stirred into a homogeneous mass, an 8 kg casting was first poured. Another 3 kg of paraffin were added to the mass remaining in the mixer and, after melting, another 10 kg of the screen fraction <3 mm separated from the fine fraction of the spent potliner were added while stirring. The second casting was created from this. Further castings were created accordingly by repeating the respective steps.

The castings of the screen fraction <3 mm separated from the fine fraction of the spent potliner dehomogenize somewhat during the solidification process. This leads to a higher concentration of wax near the surface of the casting.

It can be assumed that, with increasing fineness of the spent potlining material, less wax is required for stable shaping, regardless of the chosen form of administration. Adding more wax than is necessary for physical stability is a good way of increasing the heating value as desired and adapting it to the requirements of subsequent use.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. Spent potlining material containing spent potliner from aluminum electrolysis cells, and at least one hydrophobic binder, wherein the spent potliner is present in agglomerated form with the hydrophobic binder, wherein the hydrophobic binder is selected from wax, a wax-like compound, or mixtures thereof, wherein the spent potlining material contains 30 to 90 wt. % spent potliner and 10 to 70 wt. % hydrophobic binder, relative to the total weight of the spent potlining material.

2. Spent potlining material according to claim 1, wherein the spent potliner has a grain size of less than 50 mm.

3. Spent potlining material according to claim 1, wherein the spent potliner consists of the first cut or the second cut or a mixture of the first and second cuts, wherein the first cut consists of the graphite of the cathode lining, and the second cut constitutes a mixture of the graphite of the cathode lining and the refractory lining.

4. Spent potlining material according to claim 1, wherein the hydrophobic binder has a dripping point according to DIN ISO 2176 between 35° C. and 75° C.

5. Spent potlining material according to claim 1, wherein the wax is selected from natural wax, semi-synthetic wax or synthetic wax, and mixtures thereof, preferably from polyolefin waxes, in particular polyethylene waxes, or paraffin waxes.

6. Spent potlining material according to claim 1, wherein the wax-like compound is selected from esters of glycerol with fatty acids, preferably from linear carbon chains having 4 to 26, typically 12 to 22, carbon atoms, fatty acids, in particular linear aliphatic monocarboxylic acids having 13 to 21 carbon atoms, and mixtures thereof; preferably the wax-like compound is stearin.

7. Spent potlining material according to claim 1, wherein the spent potlining material is in the form of pellets, cocoons, castings, briquettes, or extrudates.

8. Spent potlining material according to claim 1, wherein the cathode material has a heating value between 10,500 and 31,000 KJ/kg, determined according to the RAL-GZ 724 method of the German Federal Quality Association for Secondary Fuels.

9. Method for producing a spent potlining material, comprising the following steps:

(a) providing spent potlining material from aluminum electrolysis cells, (b) comminuting the spent potliner at least in one comminuting apparatus, (c) fractionating the spent potliner through a separating apparatus, (d) mixing the spent potliner with at least one hydrophobic binder, selected from wax, a wax-like compound, or mixtures thereof, in a mixing apparatus, (e) portioning the mixture obtained in step (d), (f) extracting the spent potlining material, wherein steps (b) to (d) are carried out in an inert gas atmosphere.

10. Method for producing a spent potlining material according to claim 9, wherein the at least one comminuting apparatus in step (b) is a mill or a crusher.

11. Method for producing a spent potlining material according to claim 1, wherein the separating apparatus in step (c) is a sieve.

12. Method for producing a spent potlining material according to claim 1, wherein the at least one hydrophobic binder is metered to the mixing apparatus in step (d) in liquid form or is liquefied by heating in the mixing apparatus.

13. Method for producing a spent potlining material according to claim 1, wherein the portioning in step (e) is selected from in-mold casting, briquetting, extruding, or pelletizing.

14. Use of the spent potlining material according to claim 1 as a fuel, preferably in power stations and in the production of mineral wool, cement, and steel.

* * * * *